United States Patent [19]

Stutzenberger

[11] Patent Number: 4,884,543

[45] Date of Patent: Dec. 5, 1989

[54] FUEL INJECTION PUMP FOR COMBUSTION ENGINES

[75] Inventor: Heinz Stutzenberger, Vaihingen/Enz, Fed. Rep. of Germany

[73] Assignee: Robert Bosch GmbH, Stuttgart, Fed. Rep. of Germany

[21] Appl. No.: 269,335

[22] Filed: Nov. 10, 1988

[30] Foreign Application Priority Data

Dec. 24, 1987 [DE] Fed. Rep. of Germany ..... 37441868

[51] Int. Cl.[4] ..... F02M 39/00

[52] U.S. Cl. ..... 123/387; 123/503; 123/373

[58] Field of Search ..... 123/449, 387, 503, 500, 123/373

[56] References Cited

U.S. PATENT DOCUMENTS

| | | | |
|---|---|---|---|
| 4,170,976 | 10/1979 | Eckert | 123/387 |
| 4,200,075 | 4/1980 | Takahashi | 123/447 |
| 4,278,058 | 7/1981 | Berner | 123/387 |
| 4,387,683 | 6/1983 | Eheim | 123/387 |
| 4,409,942 | 10/1982 | Eheim | 123/387 |
| 4,459,957 | 7/1984 | Eheim | 123/373 |
| 4,505,244 | 3/1985 | Smith | 123/447 |

FOREIGN PATENT DOCUMENTS

| | | | |
|---|---|---|---|
| 3135877 | 3/1983 | Fed. Rep. of Germany | 123/449 |
| 2102508 | 2/1983 | United Kingdom | 123/449 |

*Primary Examiner*—Carl Stuart Miller
*Attorney, Agent, or Firm*—Edwin E. Greigg

[57] ABSTRACT

Fuel injection pump having a pump piston including a working space that is connected via a check valve with a reservoir closed off by a movable wall. A control line leads from this reservoir to a regulating cylinder. An adjustable regulating member is displaceably disposed in this regulating cylinder, permitting adjustment of the fuel quantity control slide according to the position of the regulating member. The subject of the invention achieves a simple construction for a fuel injection pump, for which only a small amount of drive power is required.

10 Claims, 1 Drawing Sheet

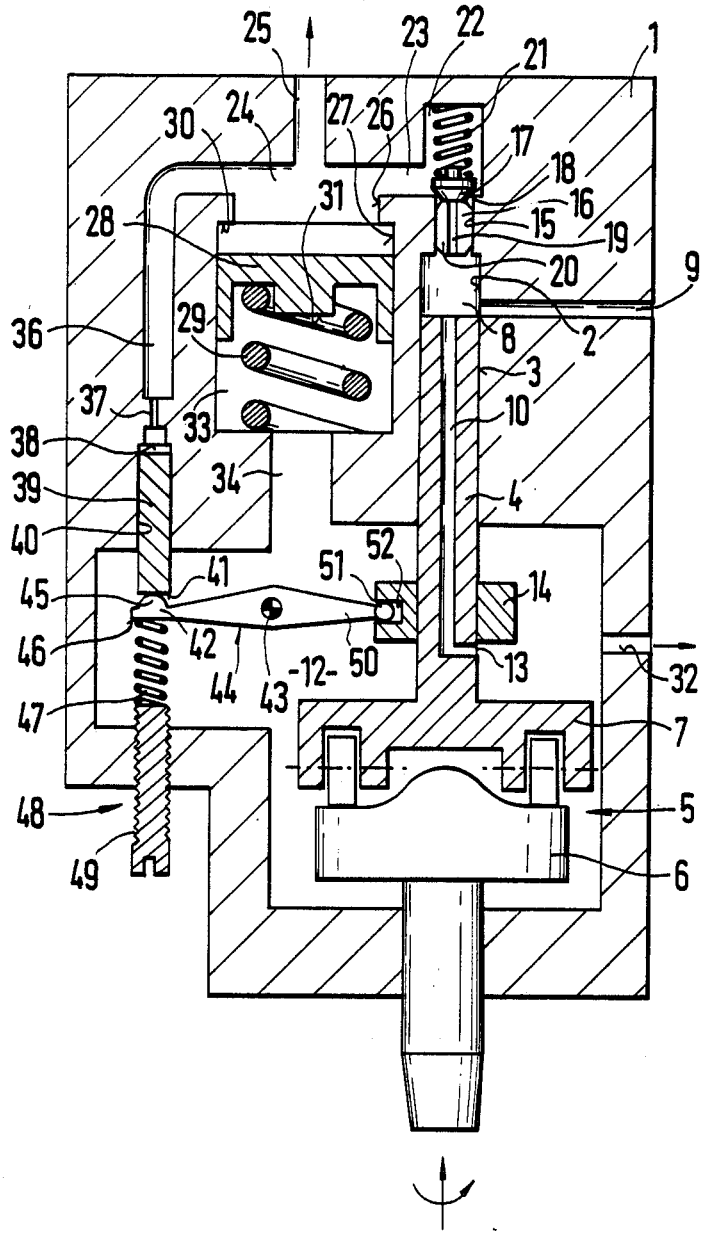
25
23
22
21
1
30
24
27
26
17
18
16
15
19
31
28
20
9
36
29
8
2
3
37
10
33
38
34
39
4
40
52
51
41
14
45
42
46
44
43
-12-
50
13
32
47
7
48
5
49
6

FUEL INJECTION PUMP FOR COMBUSTION ENGINES

BACKGROUND OF THE INVENTION

The invention is directed to a fuel injection pump for fuel injection combustion engines.

In a known fuel injection pump of this type (German Offenlegungsschrift No. 3,004,460), optimization of injection is achieved by controlling the pressure in a pressure reservoir. The hydraulic fluid available from this pressure reservoir serves the controlled actuation of a pump piston that delivers a previously stored quantity of fuel for injection. The reservoir is embodied as a constant volume reservoir, thus having the disadvantage that only a small amount of fuel can be taken from the feed space of the high pressure pump without a noticeable loss of pressure.

This known fuel injection pump is very complex in respect of its control over the quantity of fuel to be injected and in respect of its control over the actuating force for the injection, inasmuch as it requires, in addition to a electrically controlled dosing valve and an electrically controlled adjustment for the quantity of fuel to be delivered, a mechanically controlled valve arrangement for distributing the quantity of fuel to be injected to the various injection points (a distributor injection pump).

Control of the start of injection is disadvantageously controlled by the leading edges of a pump piston and distributor piston and thus permits only a narrow range of control within the limits imposed by the pump piston stroke drive or within the adjustment range available from the pump piston cam drive, respectively.

OBJECT AND SUMMARY OF THE INVENTION

The fuel injection pump according to the invention has the advantage of achieving greater flexibility in establishing the injection timing. The subject of the invention permits a simple construction. In particular, the pump that fills the reservoir is self-regulating an attains good overall efficiency. The regulation provides that only the precise quantity of fuel acquired through the solenoid valves arrives at the reservoir, plus a small additional amount to compensate for unavoidable leakage, so that the resulting fuel injection pump requires the least possible drive power.

The device includes a two-armed rocker lever whose various optional lever arm positions allow optimal setting of the regulation slide.

The device has a simple construction based on the principle of the distributor injection pump, and control over the obstruction of the relief duct in the pump piston is achieved in a simple manner.

BRIEF DESCRIPTION OF THE DRAWING

An exemplary embodiment of the subject of the invention is presented in the single drawing.

DESCRIPTION OF THE PREFERRED EMBODIMENT

The drawing shows the basic arrangement of the fuel injection unit with reference to the exemplary embodiment. A pump piston 4 is displaced in a reciprocating and simultaneously in a rotating motion by a cam drive 5 having a cam plate 6 and a roller ring 7 against the force of a return spring (not shown). The pump piston operates in a bore 2 in a cylinder 3 in a pump housing 1.

The bore 2, along with the pump housing 1 and the pump piston 4, defines a working chamber 8 for the injection pump. The working chamber 8 is supplied with fuel through a feed channel 9 in the pump housing 1, which feed channel is connected with a feed pump that feeds fuel to the work chamber as long as the pump piston executes its downward intake stroke.

A relief duct 10 extends axially of the piston and has one end of which is connected to the working chamber 8 and the other end of which leads to the interior space 12 of the housing. The outlet or respectively the outflow opening 13 of this relief duct 1 is controlled by an axially displaceable fuel quantity control slide member in the form of a cylindrical slide plate 14. The outlet or respectively the overflow opening 13 of relief duct 10 is unobstructed, once the pump piston 4 has travelled a specified distance on its delivery stroke, in that said opening emerges from the fuel quantity control member, the revolving slide plate 14, which interrupts the high-pressure delivery of fuel; and additional fuel that is delivered flows back out of the working chamber 8 into the interior space 12.

A check valve of any suitable type such as a valve cone, a bad check valve, as well as a flat-seat valve, is installed between the working chamber 8 and a reservoir 24. The check valve shown includes an insert 16 in passageway 15. The insert 16 includes an axial small diameter duct 19 and vertical slots 20. A valve cone 17 including a guide stem 19 movable in the axial duct seats against the valve seat 18 at the outlet end of passage 15. The valve 17 is spring loaded by a spring 21 which has one end seated within a blind bore spring well 22 of the housing. During the upward stroke of pump piston 4, fuel is forced from the working chamber 8 through the vertical slots 20 which raises valve 17 from the seat 18 to permit fuel flow to the reservoir 24 and out to the injection valves not shown. The valve 17 will close during the downward stroke of piston 4 during which time fuel is admitted to the working chamber 8 via the fuel supply chamber 9.

The smaller diameter bore 19 leads from the working chamber 8 to the bore 22 from which channel 23 leads to the reservoir 24. The smaller diameter duct 19 is closed by the check valve 17 that opens in the direction of discharge from the working chamber 8 to permit fuel flow via duct 19 and the bore 23 to the reservoir 24. The reservoir 24 comprises a first cylindrical section 26 of smaller diameter than a second cylindrical section 27, in which a displaceable wall 28 is guided as a storage piston, the back of the wall is loaded by a compression spring 29 which is supported against the pump housing 1 and is disposed in a cylindrical spring well 33. The dimensions of the compression spring 29 contacting the back 31 of the storage piston are such that the spring precompresses the storage piston 28 against the stop 30 formed by the smaller diameter cylindrical section 26. This ensures that after the engine has been off for some time, in the course of which the storage piston 28 has run up against the piston stop 30 due to unavoidable leakage, adequate reservoir pressure will be available for starting the engine after a small number of engine revolutions, because at low engine speeds the delivery pressure from working space 8 is high enough that fuel flows in the supply line but not enough to compress the compression spring 29 that contacts the back 31 of the storage piston. A connecting channel 34 runs from the spring space 33 to the housing interior space 12. The connecting channel 34 ensures that leaked fuel gets to the interior space 12 and from there flows back via a leakage channel 32 via a return line to the fuel tank. A supply line 25 extends from the reservoir 24, through which supply line the fuel flows to solenoid controlled injection valves (not shown) that are used to control the quantity of fuel to be injected and the injection timing at one or more injection sites in the combustion engine.

Besides the supply line 25 extending from the reservoir 24 to the solenoid valves, a control line 36 leads away from the reservoir 24, in which control line a throttle 37 is installed. This throttle 37 serves to smooth the pressure cycles arising from the delivery strokes of the pump piston 4 a it delivers fuel to the reservoir 24. After damping of the pressure cycles, the pressure in the interior space of the reservoir loads the top 38 of a regulating piston 39 that slides axially in a regulating cylinder 40. A portion of regulating piston 39, including its bottom 41, extends into the interior space.

A first lever arm end 42 of a two-armed rocker lever 44 that pivots around a pivot point 43 that is rigidly disposed within the pump housing 1 contacts the bottom 41 of the regulating piston 39. A spherical section 45 is disposed on the first lever arm end 42 as a contact surface to the bottom of the regulating piston, and a flat surface 46 is made opposite the spherical portion 45 of the rocker lever 44. This flat surface 46 is contacted by a guided coil spring 47. The other end of this coil spring 47, away from flat surface 46, contacts an adjustable arrangement 48. The adjustable arrangement 48 comprises a threaded rod 49 that extends out of the pump housing 1, by means of which the precompression of the coil spring 47 is adjusted. A trunnion 51 on the second lever arm end 50 of the two-armed rocker lever 44 engages a groove 52 in the fuel quantity control slide 14 so as to actuate the latter.

Actuation of the fuel quantity control slid 14 is effected by the rocker lever 44 when the pressure in the interior space of the reservoir rises so high that the regulating member 39, which is supported on the rocker lever 44 that is loaded by the adjustable coil spring 47, moves axially, this motion being transmitted to the fuel quantity control slide 14 via the rocker lever 44. When the set pressure selectable by means of the coil spring 47 is reached, the outlet or overflow opening 13 in the pump piston 4 is unobstructed earlier and the quantity delivered is reduced. In the extreme case, the quantity delivered is reduced to delivery because the overflow opening 13 will be open.

The principle illustrated is also applicable to conventional, series-produced injection pumps whose pump pistons feed into a reservoir. In this type of injection pump, the motion of the regulating member 39 is transmitted directly to a regulating rod.

The construction illustrated above can also be used for gasoline injection. In gasoline injection the backflow section would have to be separated spatially from the feed section, and the feed section would have to run in an oil bath, since due to the low viscosity of gasoline the pump would possibly not be lubricated adequately.

The foregoing relates to preferred exemplary embodiments of the invention, it being understood that other variants and embodiments thereof are possible within the scope of the invention, the latter being defined by the appended claims.

What is claimed and desired to be secured by Letters Patent of the United States is:

1. A fuel injection pump including a housing (1), a cylinder bore (2) in said housing a pump piston (4) in said cylinder bore working chamber (8) formed by said piston and said cylindrical bore that communicates via a check valve with a reservoir (24), means for regulating fuel pressure in the reservoir (24), said means controlling a fuel quantity control slide (14) on said pump piston (4) to alter the quantity of fuel delivered from the working chamber (8) to the reservoir (24), a line (25) that leads from the reservoir (24) through a control site to a respective fuel injection site, a displaceable wall (28) that closes off said reservoir (24) from a cylindrical chamber (33), a control line (36) that extends from the reservoir (24) to a regulating cylinder (40), an adjustable regulating member (39) displaced in said regulating cylinder against a resetting force, and means for adjusting the fuel quantity control slide (14) according to the position of said adjustable regulating member.

2. A fuel injection pump according to claim 1 in which said adjustable regulating member (39) is a regulating piston that slides axially within said regulating cylinder (40), said regulating piston having a bottom end that extends into the interior space (12) and said bottom end is coupled indirectly to the fuel quantity control slide.

3. A fuel injection pump according to claim 1, which includes a damping throttle (37) disposed in said control line (36).

4. A fuel injection pump according to claim 2, which includes a damping throttle (37) disposed in said control line (36).

5. A fuel injection pump according to claim 1, wherein said bottom end (41) of said adjustable regulating member (39) contacts a first lever arm end (42) of a two-armed rocker lever (44), said end (42) is contacted by one end of an precompression coil spring (47) which is adjustable, said regulating member being disposed in said regulating cylinder which is disposed in the fuel injection pump housing (1) and said adjustable regulating member includes an upper end which is loaded by fuel pressure in said reservoir.

6. A fuel injection pump according to claim 5, in which said precompression coil spring (47) is adjusted by an externally adjustable arrangement (48).

7. A fuel injection pump according to claim 6, in which said two-armed rocker lever (44), is pivoted about a pivot point (43), and includes a second lever arm end (50) which movably engages the fuel quantity control slide (14).

8. A fuel injection pump according to claim 7, in which said pump piston (4) is driven by a cam in the manner of a distributor injection pump and a drive shaft of the cam drive executes several pump strokes per revolution.

9. A fuel injection pump according to claim 7, in which said piston includes a relief duct (10) which leads from said working chamber (8) to an outflow opening on an end of pump piston that extends into the interior space (12) of said housing and on which said fuel quantity control slide is embodied.

10. A fuel injection pump according to claim 1, which includes a stop for said displaceable wall (28), a spring (29) in a cylinder spring well (33) that forces said displaceable wall toward said stop, and a connecting channel (34) that extends from said spring well including said displaceable wall to an interior space (12) is said housing.

* * * * *